US005400691A

United States Patent [19]

Suttie et al.

[11] Patent Number: 5,400,691

[45] Date of Patent: Mar. 28, 1995

[54] RIGID THERMAL SLEEVE FOR A GUN BARREL

[75] Inventors: William K. Suttie, Berkshire; Edgar H. Vickers, Kent, both of England

[73] Assignee: The Secretary of State for Defence in Her Britannic Majesty's Government of the United Kingdom of Great Britain and Northern Ireland, London, England

[21] Appl. No.: 179,563

[22] Filed: Jan. 10, 1994

[30] Foreign Application Priority Data

Jan. 13, 1993 [GB] United Kingdom ..... 9300559

[51] Int. Cl.[6] ..... F41A 21/02

[52] U.S. Cl. ..... 89/14.1

[58] Field of Search ..... 89/14.1, 14.05

[56] References Cited

U.S. PATENT DOCUMENTS 4,346,643 8/1982 Taylor et al. ..... 89/14.1
4,463,653 8/1984 Pusch et al. ..... 89/14.1
4,638,713 1/1987 Milne et al. ..... 89/14.1
4,753,154 6/1988 Higashi ..... 89/14.1
4,762,048 8/1988 Higashi et al. ..... 89/14.1
4,982,648 1/1991 Bol et al. ..... 89/14.1
5,062,346 11/1991 Greve Hansen et al. ..... 89/14.1

*Primary Examiner*—David Brown
*Attorney, Agent, or Firm*—Nixon & Vanderhye

[57] ABSTRACT

A rigid thermal sleeve 5 mountable over at least part of a gun barrel 3 in such a way that it is symmetrical about a longitudinal plane A—A to provide a reduced thermal image and radar cross section. The sleeve 5 comprises thermally insulating material 13 between an inner skin 15 and an outer skin 17. The outer skin 17 is arranged to have two mutually convergent planar faces 7,9, each one of which makes up at least 15% of the outer surface of the sleeve 5 and which have a mutual line of convergence extending externally and longitudinally of the sleeve 5.

20 Claims, 2 Drawing Sheets

RIGID THERMAL SLEEVE FOR A GUN BARREL

BACKGROUND OF THE INVENTION

1. Field of the Invention

This invention relates to a rigid thermal sleeve for a gun barrel which has a reduced thermal signature and a reduced radar cross-section, and in particular to a rigid thermal sleeve for a tank gun barrel.

2. Discussion of Prior Art

In certain weather conditions a gun barrel can be heated or cooled on one side more than the other, for example, when the gun barrel is in direct sun light or when wind and rain is blowing from a particular direction. The uneven heating of the gun barrel can cause it to deform and so reduce the accuracy of the gun. This problem has conventionally been solved by thermally insulating the gun barrel from its surroundings, for example, by wrapping blankets of asbestos and/or fibre glass around the gun barrel.

In European Patent No. 0,183,432 a rigid thermal sleeve for a tank gun is disclosed which when mounted on the gun barrel of the tank defines an annular gap between the sleeve and the gun barrel. The sleeve is made of an honeycomb material sandwiched between outer and inner rigid envelopes of thermally insulating material. Such an arrangement effectively insulates the gun barrel from its surroundings and has the additional advantage that it can be easily removed from the gun barrel and so can be reused on replacement of the gun barrel.

However, rigid thermal sleeves of the type disclosed in EP 0,183,432 have a distinctive thermal signature, because of their distinctive shape and generally uniform temperature. Due to their insulating nature heat inputs to the surface of the thermal sleeve are not conducted into the bulk material of the sleeve leading to temperature differences between the thermal sleeve and its surroundings. The distinctive thermal signature of such thermal sleeves makes the tank on which it is used vulnerable to detection by infra-red thermal imaging equipment.

SUMMARY OF THE INVENTION

The present invention provides a thermal sleeve for a gun barrel which retains all of the advantages of the rigid thermal sleeve mentioned above but which is less vulnerable to detection by infra-red thermal imaging equipment. The sleeve according to the present invention will also provide a degree of reduction of radar cross-section for most; angles of view as compared to conventional thermal sleeves.

According to the present invention there is provided a rigid thermal sleeve for a gun barrel which is made of thermally insulating material and is mountable over at least part of the gun barrel, wherein the external surface of the sleeve includes two mutually convergent planar faces, each one of which making up at least 15% of the said external surface, having a mutual line of convergence extending externally and longitudinally of the said sleeve.

When the rigid thermal sleeve according to the present invention is mounted on the gun barrel it is oriented so that the line of convergence is underneath the gun barrel. This ensures that the planar faces are located laterally of the gun barrel and are more widely separated towards the top of the barrel than at the bottom (see FIG. 1).

A thermal sleeve will be detected by thermal imaging equipment if its temperature is different to the surroundings against which it is viewed. A distant observer viewing the thermal sleeve with thermal imaging equipment will see a combination of thermal energy emitted from the thermal sleeve towards the observer and thermal energy emitted from the surroundings of the gun and reflected by the thermal sleeve towards the observer. Because of their orientation when mounted on the gun the planar faces of the thermal sleeve will reflect thermal energy towards the observer that is emitted by the surroundings against which the thermal sleeve is observed. This makes it more difficult to distinguish the thermal sleeve from its surroundings using thermal imaging equipment.

The shape of the external surface of the sleeve as defined above will also reduce the radar cross section of the sleeve as compared to conventional sleeves for all normal angles of view from monostable radar based surveillance and weapon systems. This is because the direction of specular reflection of incident radar energy will be away from the line of sight of the detection system.

Preferably the rigid thermal sleeve is substantially symmetrical about a longitudinal plane of symmetry and the said line of convergence lies in the said plane. In use, when the sleeve is mounted on a gun barrel, the longitudinal plane of symmetry is vertical so that the balance of the gun barrel is not affected by the sleeve.

It is preferred that the planar faces extend from one end of the sleeve to the other so that the entire length of the sleeve has a reduced thermal signature and a reduced radar cross-section. Clearly, it is preferred that as much of the thermal sleeve's outer surface as possible should reflect the thermal energy emitted by the sleeve's surroundings towards a distant observer in order to maximise the proportion of its thermal signature that is reduced. Therefore, in preferred embodiments of the present invention each planar face makes at least 15% and more preferably at least 20% of the external surface of the sleeve.

The angle between the planar faces is preferably between 10° and 40°, so that the angle between each planar face and the ground when the sleeve is mounted on the gun (assuming the barrel is parallel to the ground) is preferably between 85° and 70°. This range of angles is preferred so that thermal energy emitted by the surroundings will be reflected towards observers located at a large range of altitudes relative to the thermal sleeve. This range of angles is also restricted by the overall dimensions of the sleeve which must be constrained to minimise detection in thermal, visual, near infra-red and radar wavebands.

Preferably the thermal sleeve has a hexagonal transverse cross-section, because the outer surface of such a sleeve can accommodate all of the preferred features of the present invention described above, as required.

The emmissivity of the external surface of the thermal sleeve in the infra-red wavelength ranges 3 to 5 microns and 8 to 14 microns is constrained by the characteristics that the surface of the sleeve must have in the visible and the near infra-red wavelength ranges. In the visible and near infra-red wavelength ranges the thermal sleeve must be camouflaged to minimise detection by the human eye or other detectors that operate in the visible or the near infra-red ranges. Within these constraints the emmissivity of the sleeve's surface should be minimised in order to maximise the reflectivity of the surface and thus maximise the proportion of the thermal energy received by an observer from the sleeve that is reflected from the surroundings. Therefore, the emmissivity of the outer surface of the thermal sleeve in the wavelength ranges 3 to 5 microns and 8 to 14 microns is preferably between 50% and 70% and more preferably between 50% and 60%. The infra-red wavelength ranges specified above are those ranges that can be detected by conventional thermal imaging equipment.

If the sleeve is formed in more than one piece thermal energy may leak through the sleeve where the pieces join. Such leakage is easily detected by thermal imaging equipment and so preferably the rigid thermal sleeve is formed in one piece.

Preferably the mounting of the thermal sleeve over the gun barrel defines an annular air gap between the gun barrel and the thermal sleeve. This air gap further thermally insulates the gun barrel and maintains a uniform heat distribution along the gun barrel on firing of the gun. The gap also prevents contact between the hot gun barrel and the sleeve which contact could damage the sleeve.

The thermal sleeve must be mounted on the gun barrel in such a way that it can withstand recoil forces when the gun is fired. Furthermore, there should be a thermal seal between the gun barrel and the thermal sleeve at both ends of the thermal sleeve in order to prevent heat leakage from the annular air gap. To this end, the thermal sleeve is preferably mounted on a gun barrel by mounting means located at the ends of the sleeve, each mounting means comprising;

- a flanged ring made of a resilient material, which has an internal diameter equal to the external diameter of the gun barrel and which fits into and engages the end of the thermal sleeve, and
- a thrust ring made of a strong rigid material for reinforcing said flanged ring.

BRIEF DESCRIPTION OF THE DRAWINGS

The thrust ring may be an integral part of the gun barrel or may be rigidly mounted on the gun barrel. Embodiments of the rigid thermal sleeve according to the present invention will now be described with reference to the accompanying drawings in which.

DETAILED DISCUSSION OF PREFERRED EMBODIMENTS

Figure 1:
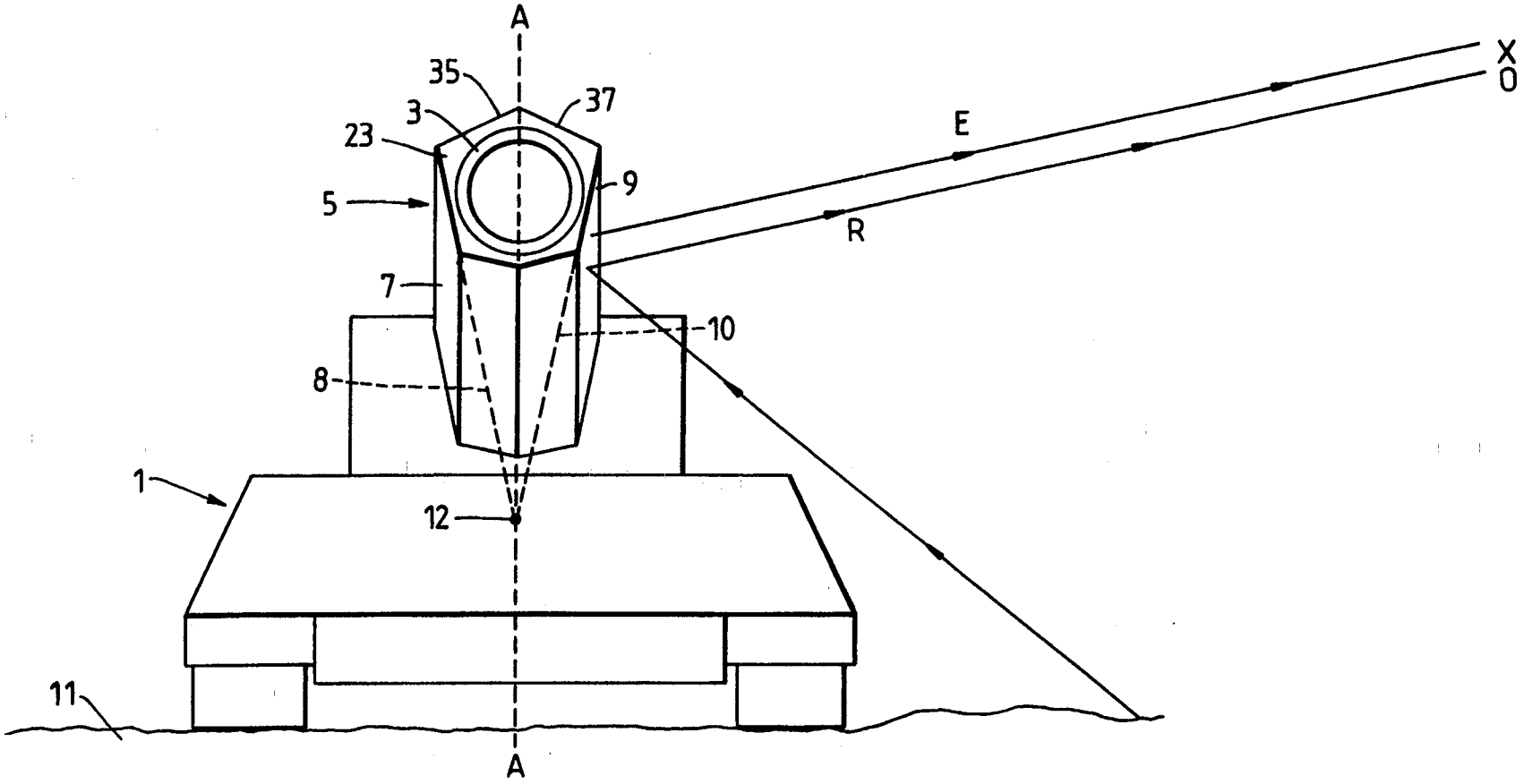
FIG. 1 shows a perspective view of a tank with a rigid thermal sleeve according to the present invention mounted on the gun barrel thereof and an observer "O" of the tank.

FIG. 1 shows a tank 1, with a gun barrel 3 upon which is mounted a rigid thermal sleeve 5 according to the present invention. The thermal sleeve 5 is mounted on the gun barrel 3 in such a way that it is symmetrical about the longitudinal plane AA which is vertical when the tank 1 rests on a laterally horizontal surface. The thermal sleeve 5 has an hexagonal outer surface including two planar faces 7 and 9 which are each oriented at an angle of 10° to plane AA. The planar faces 7 and 9 if extended along planes indicated by dotted lies 8 and 10 respectively would converge at the line of convergence 12 which lies in the longitudinal plane AA.

Figure 2:
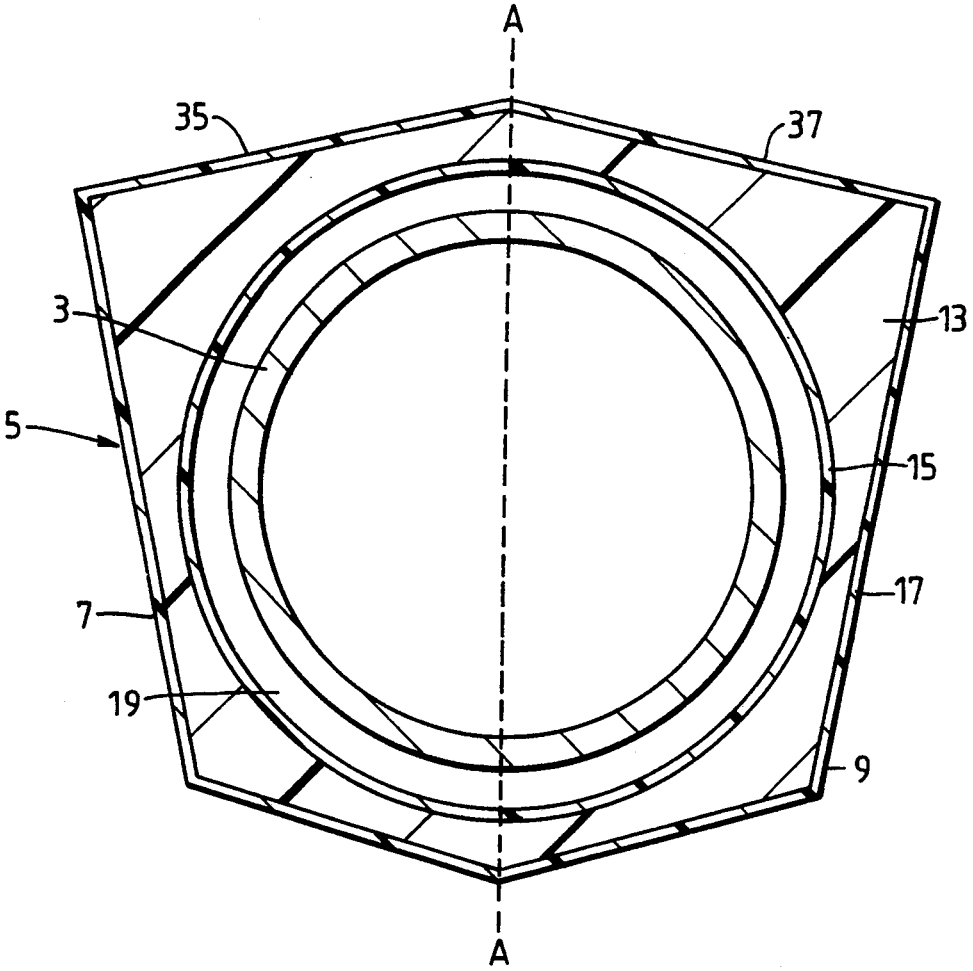
FIG. 2 shows a cross-section through the rigid thermal sleeve and tank gun barrel shown in FIG. 1 along a transverse plane perpendicular to longitudinal plane AA of FIG. 1.

The structure and composition of the thermal sleeve 5 will now be described with reference to FIGS. 2 and 3. The sleeve 5 comprises a honeycomb 13, for example, of phenolic resin polyamide. sandwiched between an inner skin 15 with a circular cross-section and an outer skin 17 with a hexagonal cross-section. Alternatively the layer 13 can be made of a foam filling. The skins 15 and 17 can be made, for example, of fibre glass or kevlar reinforced plastic. The thermal sleeve 5 is formed in one piece and is mounted on the gun barrel so as to define an annular air gap 19 between the gun barrel and the inner skin 15 of the sleeve 5. The thermal sleeve 5 is mounted on the gun barrel 3 by mounting means 21, 23 located at each end of the thermal sleeve 5.

Figure 3:
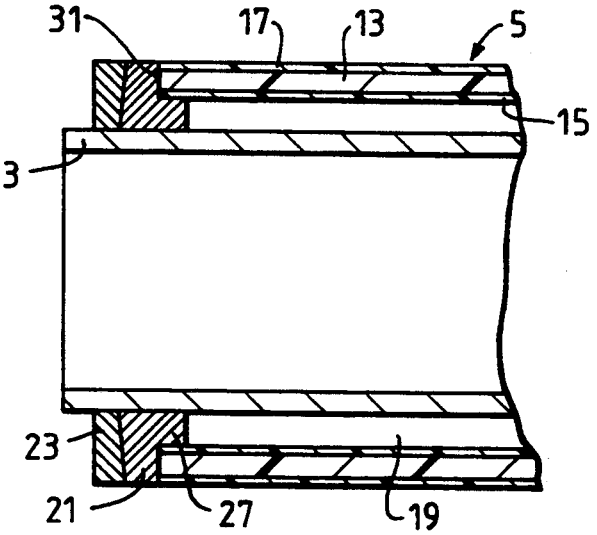
FIG. 3 shows a cross-section through the muzzle end of the thermal sleeve and tank gun barrel shown in FIG. 1 along longitudinal plane AA of FIG. 1.

FIG. 3 shows mounting means 21, 23 at the muzzle end of the thermal sleeve 5, which comprise a silicone rubber split collet 21 which is reinforced by a metal ring 23. The split collet 21 fits slideably over the gun barrel 3 and engages the end of the thermal sleeve 5 at interface 31 and the flanged portion 27 of the collet fits snugly into the end of the thermal sleeve 5. The metal ring 23 may be machined on the gun barrel 3 when it is made or it may be rigidly secured to the gun barrel 3 and in either case it reinforces the split collet 21. The mounting means 21, 23 absorb the energy of the firing forces in order to prevent the sleeve 5 from moving axially when the gun is fired and also seal the air gap 19.

The outer surface of the outer skin 17 of the thermal sleeve 5 is coloured by a mat green colouring which has a low emmissivity of around 55% in the infra-red wavelength ranges 3 microns to 5 microns and 8 microns to 14 microns. If the outer skin 17 is made of glass or kevlar reinforced plastic then it may be self coloured (as, for example, are every day plastic articles). Alternatively the outer surface of the skin 17 could coloured by an appropriate paint. A low emmissivity finish may be achieved on the outer surface of the skin 17 by including some form of metallic element therein. This may be in the form of coloured metal flakes in a paint, or metallised fibres or layers incorporated in the material from which the outer skin 17 is made.

Referring back to FIG. 1, if the outer surface of the sleeve 5 has an emmissivity of 55% as described above then 55% of the infra-red radiation, within the said wavelength ranges received by an observer "O" from the surface 9 of the sleeve 5 is emitted by the surface 9 (the path of this radiation is denoted by "E") and will thus have a level related to the temperature of the outer surface of the sleeve 5. The remaining 45% of the infra-red radiation received by the observer "O" from the surface 9 of the sleeve is reflected by the surface 9 the path of this radiation is denoted by "R"). The reflected infra-red radiation "R" comprises infra-red radiation emitted by the surroundings of the tank 1. Because of the incline of the planar face 9 the reflected infra-red radiation "R" will be emitted by the ground 11. The reflected infra-red radiation "R" will thus have a level which is related to the nature and temperature of the surroundings against which the tank 1 is observed by the observer "O". Therefore, the total infra-red radiation that is received by the observer "O" is proportionally related to the temperature of the outer surface of the sleeve 5 and the temperature of the ground 11 against which the tank is observed. Thus the thermal sleeve according to the present invention has a less distinct thermal signature relative to its surroundings than thermal sleeves used in the prior art and is correspondingly more difficult to detect with thermal imaging equipment.

The radar cross section of the sleeve as compared to conventional sleeves is also reduced because radar energy incident on the planar face 9 from the direction of the observer "O" will be reflected away from the line of sight of the observer "O" by the planar face 9.

We claim:

1. A rigid thermal sleeve for a gun barrel which is made of thermally insulating material and is mountable over at least part of the gun barrel, wherein the external surface of the sleeve includes two mutually convergent planar faces, each one of which making up at least 15% of the said external surface, having a mutual line of convergence extending externally and longitudinally of the said sleeve.

2. A rigid thermal sleeve according to claim 1, wherein each said face makes up at least 20% of the external surface of the sleeve.

3. A rigid thermal sleeve according to claim 1, wherein the angle between the convergent planar faces is between 10° and 40°.

4. A rigid thermal sleeve according to claim 1, wherein the thermal sleeve has a hexagonal transverse cross-section.

5. A rigid thermal sleeve according to claim 1, wherein the sleeve is formed in one piece.

6. A rigid thermal sleeve according to claim 1, wherein the external surface of the sleeve has an emissivity of between 50% and 70% in the wavelength ranges 3 microns to 5 microns and 8 microns to 14 microns.

7. A rigid thermal sleeve according to claim 6 wherein the emmissivity is between, 50% and 60%.

8. A rigid thermal sleeve according to claim 1, wherein the mounting of the thermal sleeve over the gun barrel defines an annular gap between the gun barrel and the thermal sleeve.

9. A rigid thermal sleeve according to claim 8 wherein the thermal sleeve is mounted on a gun barrel by mounting means located at both ends of the sleeve, each said mounting means comprising:

a flanged ring made of a resilient material, which has an internal diameter equal to the external diameter of the gun barrel and which fits into and engages an end of the thermal sleeve, and a thrust ring made of a strong rigid material for reinforcing said flanged ring.

10. A rigid thermal sleeve according to claim 1 wherein the planar faces extend from one end of the sleeve to the other.

11. A rigid thermal sleeve according to claim 10 wherein each said face makes up at least 20% of the external surface of the sleeve.

12. A rigid thermal sleeve according to claim 10 wherein the angle between the convergent planar faces is between 10° and 40°.

13. A rigid thermal sleeve according to claim 1 wherein the thermal sleeve is substantially symmetrical about a longitudinal plane of symmetry and the said line of convergence lies in the said plane.

14. A rigid thermal sleeve according to claim 13 wherein the planar faces extend from one end of the sleeve to the other.

15. A rigid thermal sleeve according to claim 13 wherein each said face makes up at least 20% of the external surface of the sleeve.

16. A rigid thermal sleeve according to claim 13 wherein the angle between the convergent planar faces is between 10° and 40°.

17. A rigid thermal sleeve according to claim 13 wherein the thermal sleeve has a hexagonal transverse cross-section.

18. A rigid thermal sleeve according to claim 13 wherein the external surface of the sleeve has an emissivity of between 50% and 70% in the wavelength ranges 3 microns to 5 microns and 8 microns to 14 microns.

19. A rigid thermal sleeve according to claim 13 wherein the sleeve is formed in one piece.

20. A rigid thermal sleeve according to claim 13 wherein the mounting of the thermal sleeve over the gun barrel defines an annular gap between the gun barrel and the thermal sleeve.

* * * * *